US010422521B2

(12) United States Patent
Chua et al.

(10) Patent No.: US 10,422,521 B2
(45) **Date of Patent: *Sep. 24, 2019**

(54) APPARATUS FOR GENERATING SYSTEM

(71) Applicant: KONINKLIJKE PHILIPS N.V., Eindhoven (NL)

(72) Inventors: Hee Keng Chua, Eindhoven (NL); Boon Khian Ching, Eindhoven (NL); Yong Jiang, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 52 days.

This patent is subject to a terminal disclaimer.

(21) Appl. No.: 14/905,297

(22) PCT Filed: Jul. 16, 2014

(86) PCT No.: PCT/EP2014/065188

§ 371 (c)(1),
(2) Date: Jan. 15, 2016

(87) PCT Pub. No.: WO2015/010968

PCT Pub. Date: Jan. 29, 2015

(65) Prior Publication Data

US 2016/0161107 A1 Jun. 9, 2016

(30) Foreign Application Priority Data

Jul. 25, 2013 (EP) ..... 13178049

(51) Int. Cl.
*F22B 1/28* (2006.01)
*D06F 75/18* (2006.01)
(Continued)

(52) U.S. Cl.
CPC ..... *F22B 1/287* (2013.01); *D06F 75/18* (2013.01); *F22B 1/284* (2013.01); *F22B 1/288* (2013.01); *F22B 1/303* (2013.01); *F22B 37/48* (2013.01)

(58) Field of Classification Search
CPC ..... A45D 4/06; B23K 3/027; D06F 75/30; D06F 75/26; D06F 75/14; H05B 1/0255
(Continued)

(56) References Cited

U.S. PATENT DOCUMENTS 2,295,341 A * 9/1942 Finlayson ..... D06F 75/18 38/77.81
2,353,604 A * 7/1944 Waring ..... D06F 75/18 38/77.9
(Continued)

FOREIGN PATENT DOCUMENTS

| | | |
|---|---|---|
| CN | 202208852 U | 5/2012 |
| DE | 7921623 U1 | 1/1980 |
| DE | 3037379 A1 | 4/1982 |

*Primary Examiner* — Jimmy Chou

(57) ABSTRACT

The present application relates to apparatus for generating steam. The apparatus comprises an evaporation surface (24), a heater (26) disposed adjacent to the evaporation surface to heat the evaporation surface, a water inlet (19) positioned relative to the evaporation surface so that water is fed onto the evaporation surface from the water inlet and forms a film on the evaporation surface such that the film is evaporated from the evaporation surface, and a scale collection region (23) positioned such that, during use of the apparatus, scale dislodged from the evaporation surface falls away from the evaporation surface into the scale collection region. The apparatus is configured so that the flow of water through the water inlet (19) and onto the evaporation surface (24) is controlled in dependence on the temperature of the evaporation surface (24) so that substantially all the water fed onto the evaporation surface is evaporated from the evaporation
(Continued)

surface without flowing from the evaporation surface into the scale collection region (23).

18 Claims, 5 Drawing Sheets

(51) Int. Cl.
*F22B 1/30* (2006.01)
*F22B 37/48* (2006.01)

(58) Field of Classification Search
USPC ..... 219/226, 242, 245, 246, 257; 38/77.8, 38/77.81, 77.82, 77.83, 77.9, 93, 77.6, 38/77.2; 392/399
See application file for complete search history.

(56) References Cited

U.S. PATENT DOCUMENTS 2,425,598 A * 8/1947 Clum ..... D06F 75/18 137/625.11
2,483,579 A * 10/1949 Green ..... D06F 75/18 38/77.83
2,499,835 A * 3/1950 Rakos ..... D06F 75/16 122/379
2,515,100 A * 7/1950 Sutton ..... D06F 75/12 38/77.6
2,588,747 A * 3/1952 Morton ..... D06F 75/18 38/77.83
2,683,320 A * 7/1954 Morton ..... D06F 75/18 122/40
2,724,198 A * 11/1955 Vance ..... D06F 75/18 38/77.83
2,726,466 A * 12/1955 Sparklin ..... D06F 75/18 38/77.83
2,727,320 A * 12/1955 Vance ..... D06F 75/18 38/77.81
2,744,342 A * 5/1956 More ..... D06F 75/18 38/77.83
2,750,690 A * 6/1956 Gomersall ..... D06F 75/18 38/77.9
2,757,464 A * 8/1956 Youhouse ..... D06F 75/18 38/77.83
2,774,156 A * 12/1956 Parr ..... D06F 75/18 38/77.83
2,793,449 A * 5/1957 Seck ..... D06F 75/18 38/77.83
2,795,062 A * 6/1957 Gomersall ..... D06F 75/18 38/77.9
2,797,507 A * 7/1957 Maykemper ..... D06F 75/18 38/77.83
2,805,497 A * 9/1957 Gomersall ..... D06F 75/18 38/77.7
2,811,793 A * 11/1957 Humphrey ..... D06F 75/14 38/77.7
2,813,358 A * 11/1957 Jepson ..... D06F 75/18 38/77.7
2,815,592 A * 12/1957 Gomersall ..... D06F 75/18 38/77.83
2,817,912 A * 12/1957 Schott ..... D06F 75/14 38/77.8
2,861,365 A * 11/1958 Block ..... A63H 33/30 219/245
3,045,371 A * 7/1962 Kurlinski ..... D06F 75/18 38/77.83
3,115,718 A * 12/1963 Henzirohs ..... D06F 75/18 38/77.83
3,165,843 A * 1/1965 Willman ..... D06F 75/18 38/77.83
3,165,844 A * 1/1965 Swanke ..... D06F 75/14 29/613
3,335,507 A * 8/1967 Vieceli ..... D06F 75/20 38/77.9
3,407,521 A * 10/1968 English ..... D06F 75/20 38/77.83
3,499,237 A * 3/1970 Piper ..... C04B 28/26 38/77.83
3,599,357 A * 8/1971 Gronwick ..... D06F 75/22 38/77.5
3,675,351 A * 7/1972 Downing ..... D06F 75/18 38/77.83
3,691,660 A * 9/1972 Gronwick ..... D06F 75/22 38/77.83
3,694,942 A * 10/1972 Vondracek ..... D06F 75/18 38/77.83
3,703,043 A * 11/1972 Ogata ..... D06F 75/18 38/77.83
3,703,777 A * 11/1972 Knapp ..... D06F 75/18 38/77.83
3,711,972 A * 1/1973 Risacher ..... D06F 75/18 38/77.83
3,823,498 A * 7/1974 Davidson ..... D06F 75/18 38/77.83
3,919,793 A * 11/1975 Toft ..... D06F 75/18 38/77.83
4,077,143 A * 3/1978 Walker ..... D06F 75/18 38/77.83
4,233,763 A * 11/1980 McMullen ..... D06F 75/38 38/77.83
4,240,217 A * 12/1980 Schwob ..... D06F 5/18 38/77.83
4,296,560 A * 10/1981 Schwob ..... F16K 1/52 38/77.81
4,414,766 A * 11/1983 Schwob ..... D06F 75/18 38/77.83
4,523,079 A * 6/1985 Albinger, Jr. ..... D06F 75/26 219/209
4,594,800 A * 6/1986 Herrmann ..... D06F 75/18 38/77.83
4,640,028 A * 2/1987 Nakada ..... D06F 75/14 16/422
4,656,763 A * 4/1987 Kawasaki ..... D06F 75/18 38/77.3
4,686,352 A * 8/1987 Nawrot ..... D06F 75/26 200/61.52
4,748,755 A * 6/1988 Bain, Jr. ..... D06F 75/14 219/245
4,837,952 A * 6/1989 Hennuy ..... D06F 75/18 38/77.7
4,857,703 A * 8/1989 Wilkins ..... B44C 7/027 392/399
4,870,763 A * 10/1989 Campbell ..... D06F 75/18 38/77.7
4,910,895 A * 3/1990 Rethmeier ..... D06F 75/18 137/512.4
4,939,342 A * 7/1990 Frens ..... D06F 75/16 219/251
5,115,117 A * 5/1992 Amiot ..... D06F 75/18 219/254
5,138,778 A * 8/1992 Brandolini ..... D06F 75/14 210/282
5,279,054 A * 1/1994 Chasen ..... D06F 75/24 219/254
5,279,055 A * 1/1994 Eckert ..... D06F 75/18 219/254
5,307,573 A * 5/1994 Watkins ..... D06F 75/18 38/77.8
5,390,432 A * 2/1995 Boulud ..... D06F 75/18 38/77.83
5,398,434 A * 3/1995 Biancalani ..... D06F 75/14 38/77.3
5,414,945 A * 5/1995 Freeman ..... D06F 79/02 219/259
5,512,728 A * 4/1996 Jalbert ..... D06F 75/40 219/246
5,526,596 A * 6/1996 Bitzel ..... D06F 79/023 219/246
5,532,455 A * 7/1996 Bouleau ..... D06F 75/20 219/245

(56) References Cited

U.S. PATENT DOCUMENTS 5,613,309 A * 3/1997 Amsel ..... D06F 75/18 38/77.83
5,615,500 A * 4/1997 Moalem ..... D06F 75/18 29/509
5,619,812 A * 4/1997 Hensel ..... D06F 75/40 219/259
5,628,131 A * 5/1997 Chasen ..... D06F 75/18 38/77.83
5,704,143 A * 1/1998 Kubicz ..... D06F 75/18 38/77.83
5,715,617 A * 2/1998 Ros ..... D06F 75/18 29/509
5,718,071 A * 2/1998 Zbriger ..... D06F 75/18 38/77.83
5,743,034 A * 4/1998 Debourg ..... C02F 5/025 38/77.8
5,842,295 A * 12/1998 Ching ..... D06F 75/12 38/77.6
5,864,122 A * 1/1999 Brandolini ..... D06F 75/24 219/255
5,883,358 A * 3/1999 Brandolini ..... D06F 75/38 219/257
5,886,322 A * 3/1999 Rivera Mendoza .... D06F 75/08 219/256
5,922,228 A * 7/1999 Hall ..... D06F 75/36 219/245
5,924,224 A * 7/1999 Demuth ..... D06F 75/18 38/77.8
5,979,089 A * 11/1999 Bouleau ..... D06F 75/20 38/77.83
6,105,286 A * 8/2000 Ching ..... D06F 75/18 38/77.83
6,125,562 A * 10/2000 Dodier ..... D06F 75/38 38/93
6,144,014 A * 11/2000 Dodier ..... D06F 75/24 219/254
6,209,239 B1 * 4/2001 Archer ..... D06F 75/18 38/77.83
6,260,514 B1 7/2001 Ehling
6,263,596 B1 * 7/2001 Pedron ..... D06F 75/18 219/255
6,314,668 B1 * 11/2001 Daulasim ..... A47J 31/605 38/77.8
6,318,009 B1 * 11/2001 De Maneville ..... D06F 75/18 38/77.8
6,427,366 B2 * 8/2002 Horn ..... D06F 75/10 38/77.83
6,590,183 B1 * 7/2003 Yeo ..... B41M 5/262 219/121.69
6,807,755 B2 * 10/2004 Bontems ..... D06F 5/14 38/77.8
6,953,912 B2 * 10/2005 Alday Lesaga ..... D06F 5/18 219/251
6,992,267 B2 * 1/2006 Wang ..... D06F 5/18 219/245
7,389,597 B1 * 6/2008 Chen ..... D06F 75/20 38/77.83
7,516,567 B2 * 4/2009 Jiang ..... D06F 75/10 38/77.83
8,051,589 B2 * 11/2011 Adams ..... D06F 79/00 219/259
9,376,768 B2 * 6/2016 Laudahn ..... D06F 75/10
2001/0034959 A1 * 11/2001 Horn ..... D06F 75/10 38/77.8
2001/0042326 A1 * 11/2001 Ching ..... D06F 75/22 38/77.3
2003/0056407 A1 * 3/2003 Boulud ..... D06F 75/18 38/77.8
2003/0094445 A1 * 5/2003 Alday Lesaga ..... D06F 5/18 219/251
2003/0121900 A1 * 7/2003 Wang ..... D06F 5/18 219/251
2003/0177673 A1 * 9/2003 Horcher ..... D06F 5/18 38/77.2
2004/0025382 A1 * 2/2004 Walther ..... D06F 5/38 38/77.83
2004/0128872 A1 * 7/2004 Voss ..... D06F 5/18 38/77.8
2004/0128873 A1 * 7/2004 Gohre ..... D06F 5/18 38/77.81
2005/0040153 A1 * 2/2005 Albandoz Ruiz de Ocenda ..... D06F 5/38 219/251
2005/0183296 A1 * 8/2005 Lesaga ..... D06F 5/18 38/77.82
2005/0278987 A1 * 12/2005 Ching ..... D06F 5/08 38/77.5
2006/0005437 A1 * 1/2006 Valiyambath Krishnan ..... A61H 33/12 38/77.8
2006/0042133 A1 * 3/2006 Maudhuit ..... D06F 75/18 38/77.8
2006/0156592 A1 * 7/2006 Zhang ..... D06F 75/20 38/93
2007/0000159 A1 * 1/2007 Kubert ..... D06F 75/18 38/93
2007/0079534 A1 * 4/2007 Lukas ..... D06F 75/20 38/93
2007/0102414 A1 * 5/2007 Jiang ..... D06F 75/10 219/245
2007/0175072 A1 * 8/2007 Lee ..... D06F 75/18 38/77.8
2007/0214689 A1 * 9/2007 Jiang ..... D06F 73/02 38/77.1
2007/0220784 A1 * 9/2007 Li ..... D06F 75/18 38/77.8
2008/0000115 A1 * 1/2008 Giersiepen ..... D06F 75/14 38/93
2008/0047172 A1 * 2/2008 You ..... D06F 75/14 38/77.5
2008/0196282 A1 * 8/2008 Jiang ..... D06F 75/26 38/77.7
2009/0000161 A1 * 1/2009 Weber ..... D06F 75/18 38/77.7
2009/0000162 A1 * 1/2009 Guohong ..... D06F 75/24 38/77.83
2010/0064557 A1 * 3/2010 Chow ..... D06F 75/20 38/77.83
2010/0122478 A1 * 5/2010 Lee ..... D06F 75/20 38/77.7
2010/0175285 A1 * 7/2010 Wiedemann ..... D06F 75/26 38/77.1
2010/0192426 A1 * 8/2010 Lin ..... D06F 75/08 38/77.1
2010/0205836 A1 * 8/2010 Wielstra ..... D06F 75/18 38/77.83
2010/0223820 A1 * 9/2010 Chadha ..... D06F 75/12 38/77.8
2010/0242316 A1 * 9/2010 Wielstra ..... F22B 37/04 38/77.83
2010/0257760 A1 * 10/2010 Choi ..... D06F 75/14 38/77.83
2010/0299975 A1 * 12/2010 Thomas ..... D06F 75/38 38/77.83
2010/0326977 A1 * 12/2010 Lee ..... D06F 75/24 219/228
2011/0035973 A1 * 2/2011 Pan ..... D06F 75/18 38/77.8
2011/0061272 A1 * 3/2011 Lee ..... D06F 75/38 38/93
2011/0271565 A1 * 11/2011 Ong ..... D06F 75/34 38/77.9
2012/0023789 A1 * 2/2012 Harrington ..... D06F 75/18 38/77.9
2012/0024015 A1 * 2/2012 Harrington ..... D06F 75/20 68/4
2012/0061372 A1 * 3/2012 James ..... D06F 75/24 219/254

(56) References Cited

U.S. PATENT DOCUMENTS

| | | | | |
|---|---|---|---|---|
| 2012/0131823 | A1* | 5/2012 | Tsang | D06F 75/12 38/77.83 |
| 2012/0131824 | A1* | 5/2012 | Tsang | D06F 75/10 38/77.83 |
| 2012/0223069 | A1* | 9/2012 | Morikawa | H01L 21/67103 219/538 |
| 2012/0324768 | A1* | 12/2012 | Janakiraman | D06F 75/18 38/77.81 |

* cited by examiner

APPARATUS FOR GENERATING SYSTEM

This application is the U.S. National Phase application under 35 U.S.C. § 371 of International Application No. PCT/EP2014/065188, filed on Jul. 16, 2014, which claims the benefit of International Application No. 13178049.6 filed on Jul. 25, 2013. These applications are hereby incorporated by reference herein.

FIELD OF THE INVENTION

This invention relates to an apparatus for generating steam, particularly but not exclusively to an apparatus for generating steam that may be incorporated into a device for applying steam to an article, such as a garment or linen.

BACKGROUND OF THE INVENTION

Many devices use steam to treat garments and other objects to remove wrinkles, for cleaning or for other purposes. For example, a steam iron discharges steam from a soleplate onto a garment to help remove wrinkles. In another example, a steam cleaner may comprise a hose with a steam applicator that a user moves to direct steam onto fabrics, such as curtains or upholstery. Typically these devices comprise a steam generator that heats and evaporates water to produce the required steam. Many other applications also require steam, such as a steamer for heating food or a steam cabinet for sterilising objects. Such devices typically go through periods of use followed periods of non-operation and this causes regular heating and then cooling of the device.

There are two common ways to evaporate water within such devices to produce steam: firstly, water can be pooled and heated to beyond boiling point to produce steam; secondly, water can be sprayed or dropped onto a heated evaporation surface which evaporates the water droplets as the water contacts the evaporation surface and creates a film which is of water on the evaporation surface. In both cases, evaporation of the water results in scale accumulating on evaporation surfaces where the evaporation occurs. Scale forms when water is evaporated and impurities and other substances which were dissolved in the water are left behind and form solid compounds. All non-ionized water will have such impurities, but scale is particularly common in areas where the mains water supply is hard water, i.e. it contains a relatively high level of impurities such as calcium and magnesium.

Presently, scale must be removed from devices to maintain performance and reliability. Scale accumulation on evaporation surfaces within the device will detrimentally affect the heating performance of the device because the scale will act to insulate the heating elements and may also block passageways. In many cases scale will accumulate on the heating element as this is where the evaporation occurs. The scale may be retained on the heating element or evaporation surface or it may flake off and be loose within the device.

Moreover, as water is heated it may react with any accumulated scale and this can result in a foam substance being produced and the heated water and steam may also carry impurities such as small bits of scale. This foam and/or impurities that may be carried by the steam can mark and stain any garment or other material which is being treated as well as cause blockages in other parts of the device.

Presently, scale must be removed by using a cleaning agent, such as a weak acid, or by physically scraping the scale off of the evaporation surfaces. Alternatively, water can be treated before being placed in the device to remove impurities and other dissolved substances and thereby reduce or eliminate the problems of scale. However, all of these methods involve effort and expense and are only partly effective. Scale greatly reduces the lifetime and performance of steam generating devices.

SUMMARY OF THE INVENTION

It is an object of the invention to provide apparatus for generating steam, a device comprising apparatus for generating steam and a method of generating steam which alleviate or overcome the problems mentioned above. The invention is defined by the independent claims; the dependent claims define advantageous embodiments.

According to one embodiment of the present invention, there is provided apparatus for generating steam comprising a water inlet, a evaporation surface and a heater adjacent to the evaporation surface such that water fed onto the evaporation surface via the water inlet forms a film on the evaporation surface and is evaporated, wherein the evaporation surface has a curved profile such that, during use of the apparatus, scale dislodged from the evaporation surface falls away from said evaporation surface.

Water is provided to the evaporation surface where it forms a film and is evaporated. Meanwhile, any scale generated by this evaporation process will fall away from the evaporation surface which means that the dislodged scale is moved away from the place where the water is evaporated. Therefore, the scale is moved away from the evaporation surface to a location which is separate from the evaporation process. This means that the steam which is generated will have fewer impurities and the problem of the foaming caused by the scale is also avoided. Moreover, the evaporation surface will not become insulated or damaged by the scale and the heating performance of the apparatus will be maintained over a longer term.

A curved profile of the evaporation surface will make it more difficult for scale to bond to the evaporation surface and will also make it easier for dislodged scale to fall away from the evaporation surface. The curved profile will mean that the scale is more susceptible to thermal shock caused by the cool water and the heated evaporation surface.

Evaporating a film of water from the evaporation surface means that the water is more quickly evaporated into steam. Moreover, any loose scale on the evaporation surface will be pushed into the adjacent scale collection region by the film of water on the evaporation surface and by the steam being produced. Furthermore, the film of water being fed onto the evaporation surface is cold relative to the evaporation surface and any scale on the evaporation surface will therefore be subjected to thermal shock. That is, the cooling effect of the water (at least until it evaporates) and the heating effect of the evaporation surface will induce thermal stresses and strains in any scale that has formed on the evaporation surface and cause it to break apart and dislodge from the evaporation surface, before falling away from the evaporation surface.

A relatively thick scale layer will experience more thermal shock because the temperature gradient through the scale layer, caused by the heated evaporation surface and the water, will be greater and the scale layer will have less flexibility. A thinner layer of scale will have a lower temperature gradient and greater flexibility, meaning less thermal stress. However, the magnitude of the thermal stress can be increased by ensuring that the heated evaporation surface is kept at a consistently high temperature. Therefore, the heated evaporation surface and the water inlet can be configured such that scale is dislodged from the evaporation surface once it reaches a predetermined minimum thickness and before it reaches a predetermined maximum thickness, ensuring that scale does not accumulate on the evaporation surface.

The apparatus may further comprise a scale collection region disposed adjacent to the evaporation surface to collect dislodged scale that has fallen from said evaporation surface. In this way, the dislodged scale which has fallen away from the evaporation surface is collected in the scale collection region. Therefore, the scale is accumulated in a place away from the accumulated scale and this avoids the previously described problems of evaporating water in the presence of accumulated scale. Moreover, the scale collection region can be configured to hold a determined volume of dislodged scale that equates to a certain lifetime or service interval of the product.

The water inlet may be configured to provide water to the evaporation surface at a rate at which substantially all of the water is evaporated on the evaporation surface and does not enter the scale collection region. Therefore no, or very little, water will enter the scale collection region where the dislodged scale accumulates. This keeps the evaporation of water separate to the accumulation of scale and the previously described disadvantages are avoided.

The evaporation element and the scale collection region may be arranged such that the evaporation surface is inclined towards the scale collection region. The incline will allow dislodged scale to more easily fall from the evaporation surface into the scale collection region. Scale will be moved into the scale collection region by the force of gravity, by the film of water which will flow down the incline until it is evaporated, and by the force of the steam being produced by evaporation of the water.

The apparatus may further comprise a casing which defines a steam chamber, the evaporation surface being formed on an evaporation element which extends into the steam chamber from one side of the casing and the scale collection region being formed within the steam chamber, adjacent to the evaporation element. In this way, the scale collection region and the evaporation surface are formed within a casing that may be used to hold steam under pressure or to direct it towards an applicator or similar application. Scale will accumulate in the scale collection region within the chamber and this region may be designed with a volume sufficient to allow the scale to accumulate without impeding the evaporation process.

The water inlet may be configured to feed water onto two or more parts of the evaporation surface. The water being fed onto the evaporation surface will cool the evaporation surface in that location and will also cool any scale which has formed on the evaporation surface in that location. Therefore, providing the water to two or more parts of the evaporation surface will result in different cooling rates of the scale and this will induce thermal shock which will act to break apart the scale such that it can fall into the scale collection region.

The water inlet may be configured to alternately feed water onto two or more parts of the evaporation surface. Alternately feeding water onto two or more parts of the evaporation surface enables the evaporation surface temperature to increase during the period when water is not being fed onto one part of the evaporation surface. In this way, the temperature of that part of the evaporation surface will increase to induce thermal shock on any scale when water is next fed onto that part of the evaporation surface. Therefore, the water inlet can continuously feed water onto the evaporation surface because there is always at least one part of the evaporation surface that is at a sufficiently high temperature to create thermal shock in any scale. Such an embodiment will ensure that the thermal shock, determined by the temperature of the evaporation surface, will be always be within predetermined minimum and maximum values, regardless of any variation in the usage of the apparatus.

The water inlet may be configured to simultaneously feed water onto two or more parts of the evaporation surface. Simultaneously feeding water onto two or more parts of the evaporation surface, for example by spraying water onto the evaporation surface, will result in different cooling rates in different parts of the evaporation surface and any scale which has formed on the evaporation surface. This will cause the scale to be broken apart and dislodged so that it can fall away from the evaporation surface.

The curved profile of the evaporation surface may be configured to generate a predetermined steam rate. The required curvature of the evaporation surface is a function of the area of the film of water, which depends on the required steam generating capacity of the apparatus. The scale layer will form on the area of the evaporation surface on which the film of water is formed and a smaller area of the evaporation surface for evaporating water will require a smaller curvature, while a larger area of the evaporation surface for evaporation water will require a larger curvature to facilitate efficient scale breakage. Furthermore, dislodged scale is easily able to move over the curved evaporation surface to fall away from the evaporation surface.

The evaporation surface may comprise a dome shaped profile. A dome shaped profile means that water being provided to the evaporation surface will flow substantially evenly over all parts of the evaporation surface so that an even film of water is formed and evaporated. Moreover, the dome shaped profile means that dislodged scale will be pushed down the dome by the film of water and by any steam being produced by the evaporation surface as the steam moves away from the evaporation surface. Therefore, the dome shape of the evaporation surface, the water and the steam will act to push any dislodged scale so that it falls away from the evaporation surface.

The evaporation surface may comprise one or more regions with recessed features. The evaporation surface may be provided with recessed regions, such as grooves or dimples, which will act to disturb any bias in the direction that water flows over the evaporation surface. It is advantageous to form a thin film of water over as much of the evaporation surface as possible as this will ensure the water is quickly evaporated, induces maximum thermal shock in any scale on the evaporation surface, and prevents the water from reaching the scale collection region. By providing the evaporation surface with one or more recessed regions the water flow will be spread out more and any prevailing flow will be disturbed and more evenly distributed.

The scale collection region may extend about the periphery of the evaporation surface. Therefore, dislodged scale is moved outwards from the evaporation surface and away from the location of the evaporation of water.

The apparatus may further comprise an embedded heating element disposed proximate to the evaporation surface. By embedding the heating element proximate to the evaporation surface the lag time between the heater being turned on and the evaporation surface reaching the required temperature is reduced, which allows the apparatus to react quickly to the evaporation surface being cooled and maintain a sufficiently high temperature. Moreover, the proximity of the embedded heater to the evaporation surface will increase the thermal shock imposed on any scale which is on the evaporation surface. This will help to break apart and dislodge that scale so that it can fall away from the evaporation surface.

The apparatus may further comprise a sensor to determine the temperature of the evaporation surface and a controller configured to operate the heating element in dependence on the determined temperature of the evaporation surface. Therefore, the apparatus is able to maintain a consistent high temperature in the evaporation surface and evaporate water at the desired rate as well as induce thermal shock in any scale on the evaporation surface. Moreover, maintaining a consistent high temperature will ensure that substantially all of the water being provided to the evaporation surface is evaporated on the evaporation surface and does not reach the scale collection region where scale accumulates.

The evaporation surface may comprise a wall having varying thickness such that, when the evaporation surface is heated or cooled during use, thermal expansion will cause the size and/or shape of the evaporation surface to change in an irregular manner to dislodge scale from the evaporation surface. In this way, the expansion and contraction of the evaporation surface will cause any scale formed on the evaporation surface to break apart and become dislodged, so that it can fall away from the evaporation surface.

The apparatus may further comprise a scale collection chamber and a channel disposed such that when the apparatus is rotated from an operational position, in which water is provided to the evaporation surface, into a rest position, in which water is not provided to the evaporation surface, scale dislodged from the evaporation surface will pass along said channel into said scale collection chamber which is configured to retain said scale. In this way, dislodged scale can be moved from the vicinity of the evaporation surface and collected in the scale collection chamber which may be further from the evaporation surface where evaporation takes place. The scale can be moved during use of the device and moving the scale will further reduce any interaction between the water and steam and the accumulated scale.

The channel may further comprise an angled member disposed such that scale moving along the channel is able to move in a direction away from the evaporation surface towards the scale collection chamber over a first evaporation surface of the angled member and scale is prevented from moving from the scale collection chamber back towards the evaporation surface by a second evaporation surface of the angled member. The angled member will retain the accumulated scale in the scale collection chamber and therefore separate it from the evaporation surface and the evaporation process. Therefore, the interaction between the water and steam and the accumulated scale is reduced and the previously described problems are further overcome.

The scale collection chamber may be openable to allow a user to remove scale from the scale collection chamber. Therefore, a user is able to remove accumulated scale from the scale collection chamber and further increase the operational life of the apparatus and reduce the interaction between the steam and accumulated scale.

According to another aspect of the present invention, there is provided a device for applying steam to an article, the device comprising the apparatus for generating steam according to any preceding claim.

According to another embodiment of the invention, there is provided a method of generating steam, the method comprising the steps of:

providing a evaporation surface with a heater positioned adjacent to the evaporation surface;

arranging a water inlet to feed water onto the evaporation surface such that it, during use of the apparatus, said water forms a film on the evaporation surface is evaporated; and shaping the evaporation surface such that, during use of the apparatus, scale dislodged from the evaporation surface falls away from the evaporation surface.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF EMBODIMENTS

Figure 1:
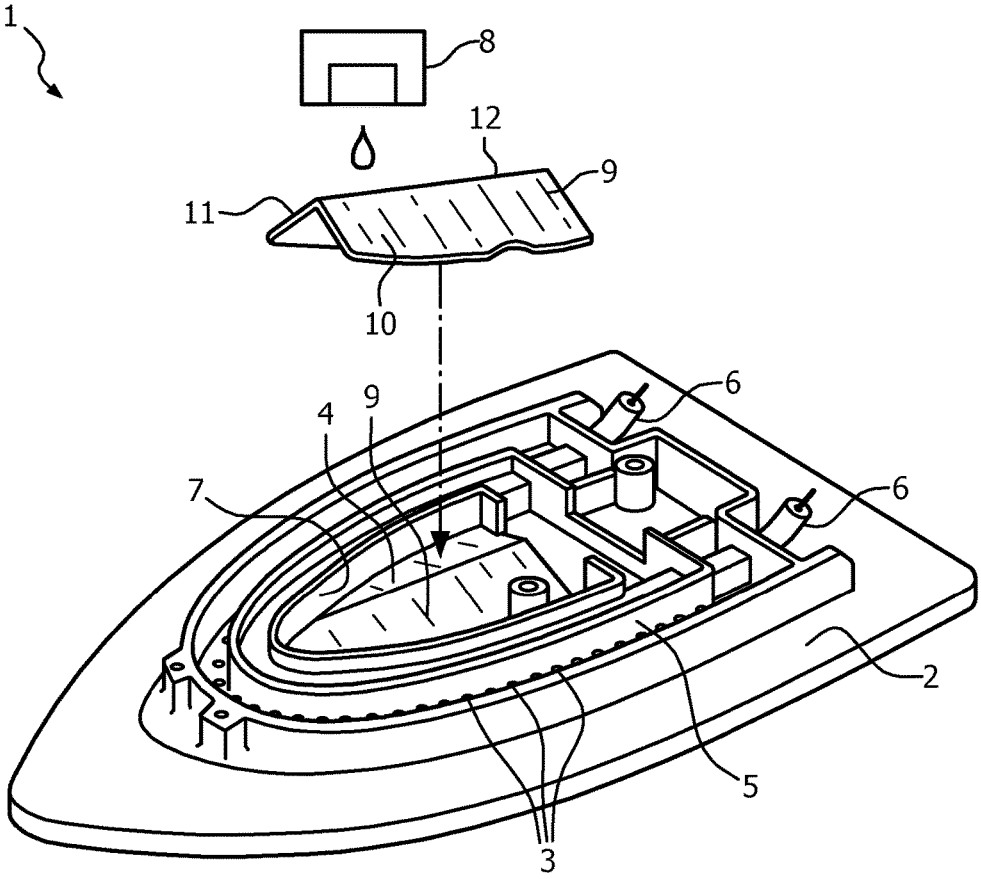
FIG. 1 (Prior art)
FIG. 1 shows a device for generating steam which is known from U.S. Pat. No. 5,613,309.

FIG. 1 shows a steam iron 1 which is known from U.S. Pat. No. 5,613,309. The steam iron 1 comprises a soleplate 2 with a series of openings 3 through which steam can pass to be imparted onto garments being ironed. The steam iron 1 has a steam generating chamber 4 positioned centrally above the soleplate 2 and a steam channel 5 which extends around the soleplate 2 and connects the steam generating chamber 4 with the openings 3. A heating element 6 extends around the side edge 7 of the steam generating chamber 4 to evaporate water in the steam generating chamber 4.

The steam generating chamber 4 comprises a water drop dispensing device 8 that feeds water droplets from a water reservoir into the steam generating chamber 4 where the water is evaporated. The steam generating chamber 4 also includes a baffle device 9, which, for clarity, is shown positioned within the steam generating chamber 4 and also removed from the steam iron 1. The baffle device 9 has two opposing inclined evaporation surfaces 10, 11 joined at a ridge 12 which is positioned below the water drop dispensing device 8. The baffle device 9 acts to separate the water droplets substantially evenly so that water flows down both inclined evaporation surfaces 10, 11 of the baffle device 9 and accumulates within the steam generating chamber 4 at the bottom of the baffle device 9, against the side edge 7 of the steam generating chamber 4 where the heater 6 is positioned. Therefore, the water is evaporated into steam on the inclined evaporation surfaces 10, 11 of the baffle device 9 and from pools formed at the bottom of the inclined evaporation surfaces 10,11, against the side edge 7 of the chamber 4 and the heating element 6.

However, because the water is evaporated on the inclined evaporation surfaces 10, 11 of the baffle device 9 and in pools formed in the bottom of the steam generating chamber 4, against the heating element 6, scale will form and accumulate in these regions. As scale accumulates the evaporation rate of the device will fall as scale acts to insulate the heating element 6 and reduce the heat transfer rate from the heating element 6 to the inclined evaporation surfaces 10,11 and subsequently the water. Eventually, unless cleaned and maintained, the device will stop working as the heating element 6 will overheat or will not be able to transfer enough heat energy to evaporate the water and produce steam. Furthermore, because scale will accumulate in the same location as the water is boiled and evaporated, the evaporated steam will carry particles and foam will be generated by water and steam reacting with the accumulated scale, as previously explained.

The lifetime of the device described with reference to FIG. 1 will be limited by the scale which will accumulate on the heated evaporation surfaces within the steam generating chamber 4.

Figure 2:
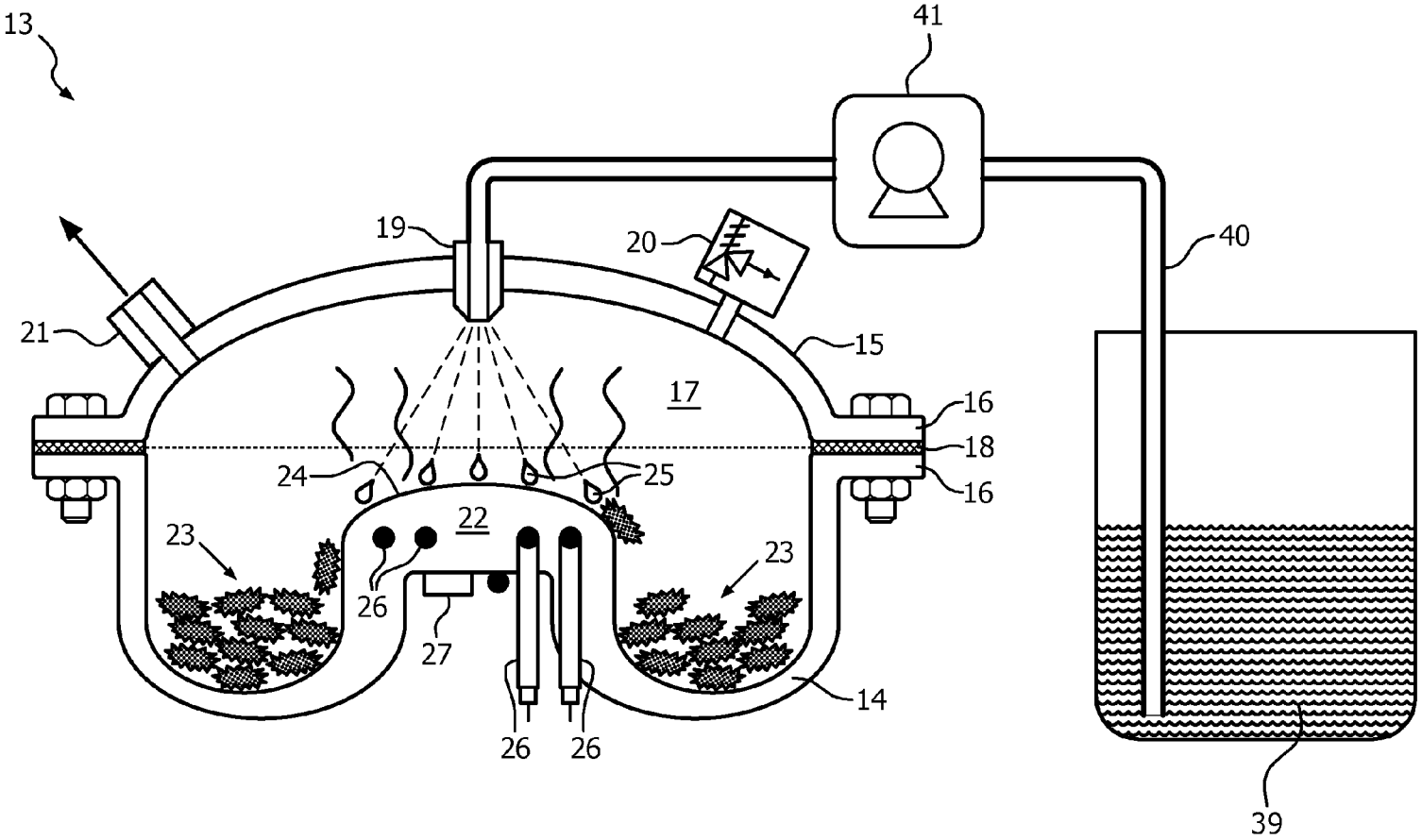
FIG. 2 shows a cross-section of apparatus for generating steam according to the invention.

FIG. 2 shows an example of apparatus for generating steam 13 according to the invention. The apparatus 13 comprises a casing formed of a first part 14 and a second part 15 which attach to each other via bolts which extend through a flange 16 on the outer edge of each part 14, 15 to form an internal steam chamber 17. In this example, the first and second parts 14, 15 of the casing are circular in shape and joined around a circumferential flange 16, although it will be appreciated that the casing 14, 15, and the steam chamber 17, may be any shape, for example the casing may be square, triangular or any other shape. The joint between the first and second parts 14, 15 of the casing may include a rubber seal 18 or gasket that is positioned between the flanges 16 of each of the first and second parts 14, 15 so that the steam chamber 17 is sealed. Steam is generated within the steam chamber 17 and this may result in medium or high pressure steam, depending on the application of the device. Therefore, the casing should be made from a suitable material and be designed accordingly. For example, the first and second parts 14, 15 of the casing may be made from a polymer material or a metal, such as aluminium. Alternatively, the first and second parts 14, 15 of the casing may be made from different materials, for example the first part 14 may comprise a cast and machined aluminium and the second part 15 may be made from a polymer material. In any case, the materials should be suitable to safely deal with the temperature and pressure associated with the application of the steam generating device.

As shown in FIG. 2, the second part 15 of the casing, which is essentially a cover or lid, comprises a water inlet 19 which feeds water into the steam chamber 17, as will be described in more detail hereinafter. The second part 15 of the casing may also comprise a pressure release valve 20 and a steam outlet 21. The pressure release valve 20 is an important safety feature and is configured to open when the pressure within the steam chamber 17 exceeds a predetermined safe level. It will be appreciated that the pressure release valve 20 may alternatively be incorporated into the steam outlet 21 or provided in the first part 14 of the casing.

The steam outlet 21 may be connected to any device, hose, pipe, tube, or other means for applying, using or conveying steam. For example, the steam outlet 21 may convey steam from within the steam chamber 17 to a steam passage of a soleplate of a steam iron similar to that described with reference to FIG. 1. Alternatively, the steam outlet 21 may convey steam from the steam chamber 17 into a hose connected to a steam applicator, such as a steam dispensing head, for applying steam to garments or other articles. It will be appreciated that the steam outlet 21 may alternatively be provided in the first part 14 of the casing. Also, the device may optionally comprise multiple steam outlets to provide steam to multiple devices or applicators.

The first part 14 of the casing comprises an evaporation element 22, which acts to heat and evaporate water being fed into the steam chamber 17, and a scale collection region 23, as will be described in more detail below with reference to FIG. 2.

As shown in FIG. 2, the first part 14 of the casing comprises an evaporation element 22 which is surrounded by a scale collection region 23. In particular, the first part 14 of the casing comprises a central protrusion that extends into the steam chamber 17, towards the water inlet 19 formed in the second part 15 of the casing. This protrusion forms the evaporation element 22 and is configured to evaporate water being fed into the steam chamber 17 by the water inlet 19. The remainder of the first part 14 of the casing forms an annular region around the protruding evaporation element 22 which is the scale collection region 23. In this example, the water inlet 19 is formed centrally in the circular second part 15 of the casing and the evaporation element 22 is formed centrally within the first part 14 of the casing, with the scale collection region 23 being an annular region which is adjacent to and surrounds the evaporation element 22. However, it will be appreciated that the water inlet 19 and evaporation element 22 may be formed in any position within the steam chamber 17 and the scale collection region 23 will occupy the space adjacent to and/or surrounding the evaporation element 22 on any side.

The evaporation element 22, which protrudes from the first part 14 of the casing into the steam chamber 17, comprises a curved evaporation surface 24 which is directed towards the water inlet 19 such that water 25 being fed into the steam chamber 17 falls onto the evaporation surface 24. In this way, the evaporation surface 24 is arranged at a different level to the scale collection region 23. The evaporation surface 24 is heated and the water 25 forms a film on this heated evaporation surface 24 which is evaporated to produce steam. In particular, the water inlet 19 is positioned directly above the evaporation surface 24 so that water falls, under gravity and/or pressure, from the water inlet 19 onto the evaporation surface 24.

The water inlet 19 may be configured to drip water 25 onto the evaporation surface 24 a regular rate. Alternatively, the water inlet 19 may be configured to feed a constant stream of water 25 onto the evaporation surface 24. Alternatively, the water inlet 19 may be configured to spray the water 25 onto the evaporation surface 24 of the evaporation element 22 so that water 25 is simultaneously provided to the evaporation surface 24 in multiple positions. Alternatively, there may be more than one inlet to introduce water 25 to multiple positions on the evaporation surface 24. Alternatively, there may be one inlet that is moveable such that it can be repositioned to introduce water 25 to different positions on the evaporation surface 24. In any case, the water 25 is provided to the steam chamber 17 in such a way that a film of water is formed on the evaporation surface 24 of the evaporation element 22 and that film of water is heated and evaporated. In this way, substantially all of the water 25 being fed into the steam chamber 17 is evaporated on the evaporation surface 24 of the evaporation element 22 and does not flow into the adjacent scale collection region 23. Therefore, substantially no water enters the scale collection region 23 and so the water can not react with the accumulated scale to create foam and impure steam.

In some of the above described examples water 25 is provided to the evaporation surface 24 in multiple positions on the evaporation surface 24. That is, multiple water droplets or a multiple streams of water contact the evaporation surface in different positions. This may be achieved by a spraying action or by having multiple water inlets. This may happen simultaneously, for example if the water inlet 19 sprays water onto the evaporation surface 24 then multiple water droplets will simultaneously be provided to the evaporation surface 24. On the other hand, water 25 may be provided to multiple positions on the evaporation surface 24 in a sequential manner. Either way, the water 25 will act to cool different areas of the evaporation surface 24, and scale on the evaporation surface 24, at different rates and by different amounts. That is, areas of the evaporation surface 24 which are directly provided with water will be cooled more rapidly than other areas of the evaporation surface 24, which will cause scale on the evaporation surface 24 to cool at different rates. This differential cooling and heating will result in stresses and strains within the scale which will cause the scale to break apart, come detached from the evaporation surface 24 and fall into the scale collection region 23.

The water inlet 19 is connected to a water reservoir 39 which provides water for generating steam. The water inlet 19 may be formed within the water reservoir 39 which is positioned directly above the second part 15 of the casing. Alternatively, as shown in FIG. 2, the water reservoir 39 may be removed from the casing and a pipe or tube 40 may connect the water reservoir 39 to the water inlet 19. A pump 41 may optionally be provided to move water from the water reservoir 39 to the water inlet 19. The pump 41 may also be configured to dose or pressurise the water such that the flow rate of water through the water inlet 19 is suitable for the apparatus. Optionally, a valve or other means of controlling the flow rate of water through the water inlet 19 may be provided in the pipe 40 or in the water inlet 19 or in the water reservoir 39 or any other suitable location.

The size and area of the evaporation surface 24 on the evaporation element 22 is selected to provide an appropriate steam generation rate. The required steam generation rate will depend on the application of the device, the pressure limitations of the casing, the maximum water feed rate and the size of the device. However, as an indication, experiments have shown that to generate steam from a water feed rate of 30 grams/minute would require a circular evaporation surface having a diameter of 49 millimeters heated to 180 degrees Celsius, or a diameter of 70 mm at 150 degrees Celsius. The evaporation surface 24 has a sufficient size and temperature to evaporate substantially all of the water 25 that is fed onto the evaporation surface 24 so that little or no water enters the scale collection region 23 surrounding the evaporation element 22.

The evaporation element 22, in particular the evaporation surface 24 onto which water 25 is fed by the water inlet 19, is heated by an electric heater. In this example, an electric heating element 26 is embedded into the evaporation element 22 such that the evaporation surface 24 is heated to evaporate water being fed into the steam chamber 17 through the water inlet 19. A temperature sensing device 27 may also be provided to measure the temperature of the evaporation element 22 and in particular the temperature of the evaporation surface 24. The temperature sensing device 27 may be positioned on an outside evaporation surface of the first part 14 of the casing and an allowance made for the decreasing temperature gradient between the evaporation surface 24 and the outside evaporation surface. Alternatively, the temperature sensing device 27 may be disposed such that it directly senses the temperature of the evaporation element just below the evaporation surface 24 or on the evaporation surface 24 itself.

In this way, a controller is able to control the heating element 26 to maintain a consistent high temperature in the evaporation surface 24 which is suitable to evaporate substantially all of the water which is entering the steam chamber 17 through the water inlet 19 and onto the evaporation surface 24. Therefore, substantially all of the water is prevented from reaching the scale collection region 23 around the evaporation element 22. Moreover, the heating element 26 is disposed proximate to the evaporation surface 24 so that the evaporation surface 24 is heated but the evaporation surface within the scale collection region 23 is not heated. In this way, no water is evaporated from the scale collection region 23 and steam will not be generated in the presence of the accumulated scale. The scale collection region 23 will become warmer than room temperature due to the generation of steam in the steam chamber 17, but the scale collection region 23 is not directly heated by the heating element 26 so that little or no evaporation will occur in the scale collection region 23.

As explained above, as water 25 is fed into the steam chamber 17 via the water inlet 19 it will fall onto the evaporation surface 24 of the heated evaporation element 22 and form a film of water on the evaporation surface 24 which is evaporated into steam. The steam will exit the steam chamber 17 through the steam outlet 21 or other means provided to carry the steam away from the steam chamber 17. If impure water is used in the device of FIG. 2 then scale will inevitably form on the evaporation surface 24 as the water is evaporated. However, as explained hereinafter, the configuration of the evaporation element 22 will prevent accumulation of scale on the evaporation surface 24 and therefore overcome the previously described problems of scale accumulation.

In the example shown in FIG. 2 the evaporation surface 24 is dome-shaped and curved such that it is inclined downwards into the scale collection region 23 around the evaporation element 22. This convex, dome-like profile means that any scale that is formed and dislodged from the evaporation surface 24 will fall away from the evaporation surface 24 into the scale collection region 23. Any loose scale on the evaporation surface 24 will be pushed towards the scale collection region 23 by the water 25 being fed onto the evaporation surface 24, the steam being produced on the evaporation surface 24 and by gravity which will pull the scale over the evaporation surface 22 and into the scale collection region 23. Moreover, the curved, dome-like profile of the evaporation surface 24 will make it more difficult for scale to accumulate on the evaporation surface 24 as the curved profile will create stresses and strains in the scale which will break it apart. Once the scale has become dislodged from the evaporation surface 24 it will fall into the scale collection region 23 around the evaporation element 24, as described above.

Although the above description describes the loose dislodged scale falling from the evaporation surface 24 into the scale collection region 23, it will be appreciated that the scale may be moved from the evaporation surface by being pushed by the water and/or steam, or it may slide over the evaporation surface 24 and into the scale collection region 23. In any case, the loose dislodged scale will fall away from the evaporation surface 24, towards the scale collection region 23.

It will be appreciated the evaporation element 22 may alternatively be provided with an evaporation surface that has a pitched, conical or pyramidal or any other shape. In any case, the evaporation surface 24 should be inclined into the adjacent scale collection region 23 so that dislodged scale moves off of the evaporation surface 24 and into the scale collection region 23.

It will also be appreciated that the apparatus may be configured to hold steam within the chamber at a pressure which is greater than atmospheric pressure so that steam can be released at any time. In this case, the water inlet 19 may be configured to open and allow water into the steam chamber when the pressure within the chamber falls below a certain level. Also, it should be considered that the boiling point of water increases as pressure increases so the heater and other components need to be selected and/or designed according to the required pressure and temperature. It will be appreciated that the maximum steam pressure can be regulated by controlling the temperature of the evaporation surface 24 and the water feed rate through the water inlet 19.

In an alternative example, the water inlet 19 may open whenever the apparatus is in use or when a user opens the water inlet 19 to allow steam to flow out of the steam outlet. In this way, steam is made 'on demand' and the user does not need to wait for a required pressure to build up before using the device.

The movement of loose scale from the evaporation surface 24 into the surrounding scale collection region 23 means that accumulation of scale on the evaporation surface 24 is prevented. Instead, scale is collected in the scale collection region 23 which is separate to the heated evaporation surface 24 where the steam is produced and so the water 25 is not evaporated in the presence of an accumulation of scale. Moreover, the disadvantages of the scale acting as an insulating material on the evaporation surface 24 are also avoided and the efficiency and effectiveness of the heating element 26 is not diminished over time.

In the example shown in FIG. 2, the heating element 26 is embedded within the evaporation element 22 such that it is in close proximity to the evaporation surface 24. This means that the evaporation surface 24 itself is maintained at a high temperature and the heating element 26 is able to quickly heat the evaporation surface 24 when the temperature drops, which will occur when water is fed onto the evaporation surface 24 and evaporated. The proximity of the heating element 26 to the evaporation surface 24 reduces the lag time between switching on the heating element 26 and the subsequent increase in the temperature of the evaporation surface 24. Therefore, the device is able to better regulate the temperature of the evaporation surface 24 and maintain a high temperature, allowing the evaporation surface 24 to evaporate all water which is fed onto the evaporation surface 24 and prevent water from reaching the scale collection region 23 surrounding the evaporation element 22.

The evaporation element 22 may also include a temperature sensor 27 which may be embedded into the evaporation element 22 or placed in proximity to the evaporation surface 24. The temperature sensor 27 is configured to quickly detect any drop of temperature in the evaporation surface 24 and a controller is configured to adjust the power of the heating element 26 accordingly. The heating element 26 may be an on-off type heater, in which case the heating element 26 is turned on when the temperature of the evaporation surface 24 falls below a predetermined value and is turned off when the temperature rises above a predetermined value. Alternatively, the heating element 26 may have a variable power output such that a more constant temperature can be maintained on the evaporation surface 24. In this way, the temperature of the evaporation surface 24 of the evaporation element 22 can be accurately maintained at a sufficiently high temperature to evaporate the water 25 being fed onto the evaporation surface 24 before it reaches the scale collection region 23. Therefore, none of the water, or at least very little water, will accumulate in the scale collection region 23.

Furthermore, the high temperature of the evaporation surface 24 and the consistency of that temperature means that scale is less likely to be retained on the evaporation surface 24 itself and will become dislodged and broken into flakes and powder that will move into the scale collection region 23 surrounding the evaporation element 22. The constant high temperature of the evaporation surface 24 combined with the relatively low temperature of the water 25 being fed onto the evaporation surface 24 means that any scale on the evaporation surface 24 will be subjected to a high thermal shock which will break apart and dislodge any scale. Any scale formed on the evaporation surface 24 will have a different thermal expansion coefficient to the material of the evaporation surface 24 itself. Therefore, as water 25 is provided to the evaporation surface 24 the scale will cool at a different rate to the material of the evaporation surface 24 and then be heated up at a different rate as the heat energy is transferred to the water. This will cause a differential rate of contraction and expansion of the scale compared to the evaporation surface 24, which will induce stresses and strains in the scale, causing it to break apart into particles and detach from the evaporation surface 24, which are then moved into the scale collection region 23 as previously explained. Even if the material of the evaporation surface 24 does not undergo any significant contraction when water is fed onto the evaporation surface 24, any accumulated scale will be cooled by the water and the thermal shock of this differential cooling will break apart the scale and allow it to move into the scale collection region 23.

Moreover, once cracks and gaps are formed in the scale layer on the evaporation surface 24, water 25 being fed onto the evaporation surface 24 will flow through those cracks and into the gaps and onto the evaporation surface 24. As this water contacts the evaporation surface 24 it will be evaporated and undergo an increase in volume as it turns into steam. This will push the scale away from the evaporation surface 24 and provides a further force acting to break apart the scale and push it off the evaporation surface 24 and into the scale collection region 23.

As previously explained, in one example the water inlet 19 or multiple water inlets may be configured to provide water to the evaporation surface 24 in multiple locations. This may be achieved with multiple water inlets, a water inlet which sprays water onto the evaporation surface, or with a moveable water inlet. Providing water to different positions on the evaporation surface will result in differential cooling of the scale layer and evaporation surface 24, differential heating of the water, and uneven steam generation across the evaporation surface 24. This will increase the magnitude of the stresses and strains created in the scale layer, causing the scale to be broken apart such that it falls into the scale collection region 23.

In another example, the evaporation element 22, including the evaporation surface 24, may be configured to alter its shape under thermal heating and cooling. In particular, the evaporation element 22 may be shaped such that when it is heated the thermal expansion of the evaporation element 22 causes the shape of the evaporation surface 24 to change in a regular or irregular manner. In this case, regular shape change will occur if the evaporation surface 24 were to expand by the same amount in every direction, that is, it undergoes regular thermal expansion and/or contraction. On the other hand, irregular shape change will occur if the evaporation element 22 and evaporation surface 24 are configured to expand more in one direction than in another. For example, the walls of the evaporation element 22 and/or evaporation surface 24 may have varying thickness so that some areas will expand more than others when heated, causing the evaporation surface 24 to change shape in an irregular manner. In either case, the thermal expansion and/or contraction will act to break apart any scale which has formed on the evaporation surface 24, which will fall into the scale collection region 23.

The evaporation surface 24 may optionally be provided with some coating or evaporation surface finish that prevents scale from becoming bonded to the evaporation surface 24 so that the scale is more easily broken apart and dislodged. For example, a non-stick coating such as PTFE or a ceramic coating, or alternatively a highly polished evaporation surface finish may be provided to make it more difficult for the scale to form into large particles and flakes on the evaporation surface 24. Furthermore, the non-stick coating or evaporation surface finish will allow greater relative movement between the scale and the evaporation surface 24. This will result in higher stresses in the scale which will be broken apart and dislodged from the evaporation surface 24 more quickly.

The evaporation element 22 described above with reference to FIG. 2 may also help to improve the evaporation of the water by overcoming the Leidenfrost effect. The Leidenfrost effect occurs when a droplet of liquid becomes suspended above a heated evaporation surface due to a vapour being formed between that evaporation surface and the liquid—the vapour is trapped and separates the evaporation surface from the liquid which impedes heat transfer. The curved evaporation surface 24 of the evaporation element 22 helps to overcome the Leidenfrost effect because water droplets that become suspended on the evaporation surface 24 due to the Leidenfrost effect will move down the curved evaporation surface 24 due to gravity. As the droplet moves across the evaporation surface friction will cause at least some of the vapour to escape and the Leidenfrost effect will be broken, allowing heat to effectively transfer to the water for evaporation. Furthermore, the high temperature evaporation surface 24 will cause the water to significantly increase in temperature before it contacts the evaporation surface 24 and it will immediately heat and evaporate the water. Therefore, the water may evaporate more quickly and the vapour layer does not have any opportunity to form, avoiding the Leidenfrost effect. This is advantageous over the evaporation of water on a flat heated evaporation surface because with a flat evaporation surface the vapour will become trapped beneath the water and suspend the water above the evaporation surface, thereby reducing heat transfer. Furthermore, the curved evaporation element 22 is advantageous over an inclined planar heated evaporation surface, such as that described with reference to FIG. 1, as the Leidenfrost effect could result in water being suspended above the heated evaporation surface at the bottom of the inclined evaporation surface, against the heating element, thereby reducing the transfer of heat energy to the water.

The arrangement of the evaporation element 22 and scale collection region 23, as described above with reference to FIG. 2, means that water is not evaporated in the scale collection region 23. As explained, scale is prevented from accumulating on the heated evaporation surface 24 so that water is evaporated on a relatively clean and scale-free evaporation surface. This will help to prevent the accumulation of scale which will improve product performance and longevity. Furthermore, because water is mostly prevented from reaching the scale collection region 23, foaming and contamination of the steam, which is otherwise caused by heating water in the presence of scale, is reduced or eliminated.

The arrangement of the evaporation element 22 and scale collection region 23 results in better performance of the steam generating device as the scale does not accumulate and so heat transfer from the evaporation surface 24 to the water is not reduced. This will also increase the longevity of the device and the potential required time between cleaning or servicing to remove scale.

Figure 3:
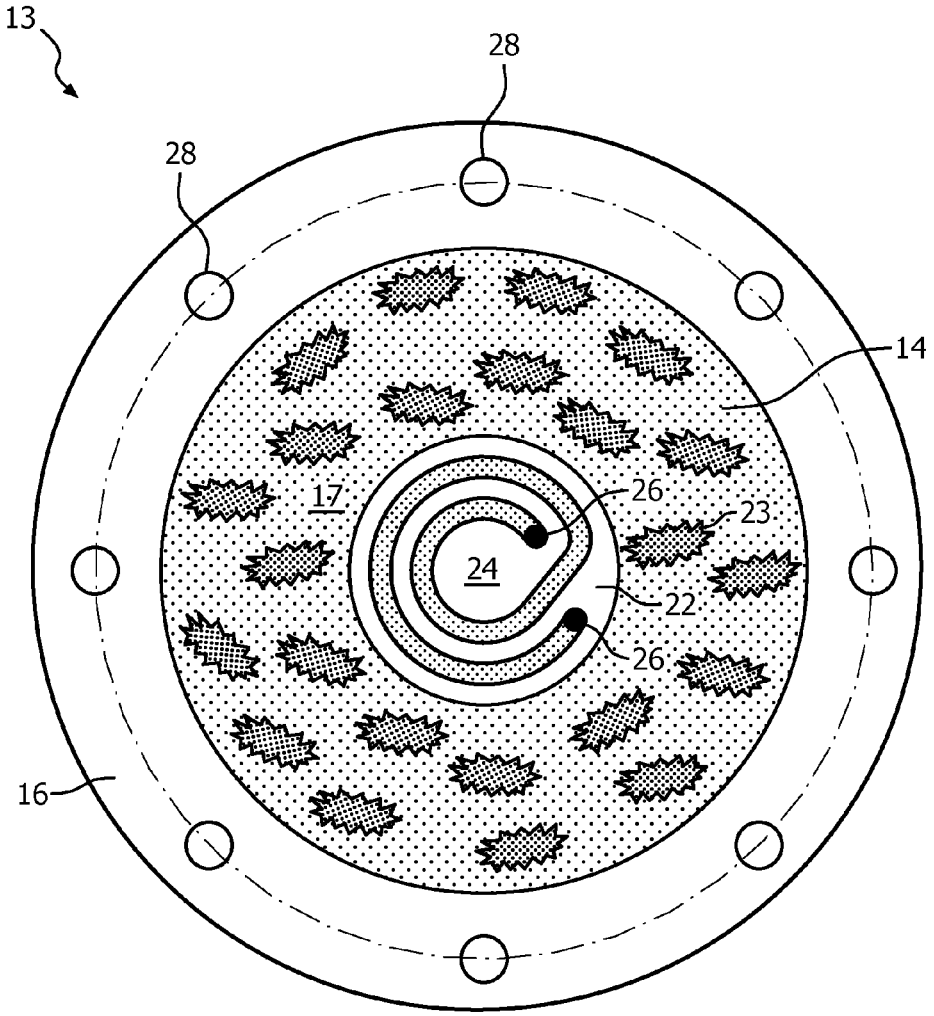
FIG. 3 shows a top view of a part of the apparatus of FIG. 2.

FIG. 3 shows a top view of the apparatus described with reference to FIG. 2, with the second part 15 of the casing removed so that the internal features of the first part 14 of the casing are visible. In particular, in this example the first part 14 of the casing is circular and comprises a flange 16 and a plurality of fixing holes 28 around a peripheral edge of the first part 14 of the casing so that the second part 15 of the casing can be fixed onto the first part to define the steam chamber 17 with bolts, rivets or other fasteners. Moreover, FIG. 3 shows the evaporation element 22 that protrudes centrally within the first part 14 of the casing into the steam chamber 17. The evaporation element 22 is surrounded by an scale collection region 23 which, as explained with reference to FIG. 2, is arranged adjacent to the evaporation element 22 so that scale formed by evaporation of water on the evaporation surface 24 will collect in this region.

Also shown in FIG. 3, the electric heating element 26 embedded in the evaporation element 22 is wound in a spiral form so that the entire evaporation surface 24 of the evaporation element 22 is heated uniformly by the heating element 26. In this way, the heating element 26 is able to quickly heat the entire evaporation surface 24 to react to any change in temperature and thereby maintain a consistent high temperature which, as previously explained, helps to prevent scale accumulation on the evaporation surface 24. Alternatively, the heating element 26 maybe disposed elsewhere within the apparatus and configured to heat the evaporation surface 24.

The size and volume of the scale collection region 23 surrounding the evaporation element 22 can be configured to define how often the scale must be removed from the device to maintain performance. For example, if the product should be designed with a lifetime of 6 years then, based on a 100 liters-per-year usage of water with a calcium carbonate concentration of between 120 and 180 milligrams/liter, the volume of scale generated will be approximately between 195 and 293 cubic centimeters. However, given that the flakes or powder particles of scale will not occupy all the volume in which they are disposed, a scale collection region having a volume of approximately 600 cubic centimeters may be provided so that the device can operate for up to 6 years without the scale detrimentally affecting the performance of the evaporation element.

It will be appreciated that the above description is merely an example of a possible volume of the scale collection region 23 and the scale collection region 23 may alternatively be any size. If, for example, a longer or shorter product life is required then the volume can be adjusted accordingly. Also, the scale collection region 23 may have a volume which is smaller than the expected volume of scale over the entire lifetime of the product and the product may be provided with a predetermined service interval or indicator so that the consumer knows when to remove the accumulated scale. Alternatively, as described in more details hereinafter, a device having the apparatus described above may be provided with a way of removing scale.

In another example, the evaporation surface 24 may be provided with one or more recessed regions, for example a groove or a plurality of dimples. The recessed region(s) may be provided to ensure that the film of water being formed on the evaporation surface 24 is substantially evenly distributed and does not always flow in the same direction. The recessed regions will act to disturb any prevailing flow of water and spread the water over a greater part of the evaporation surface 24, resulting in better evaporation.

Figure 4A:
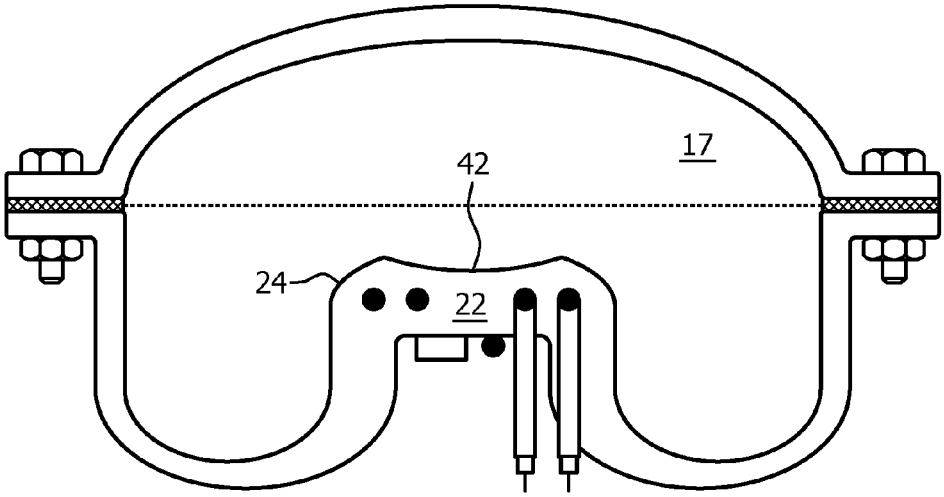
FIG. 4*a* shows a cross-section of an embodiment of apparatus for generating steam, having an evaporation surface with a recessed region.
Figure 4B:
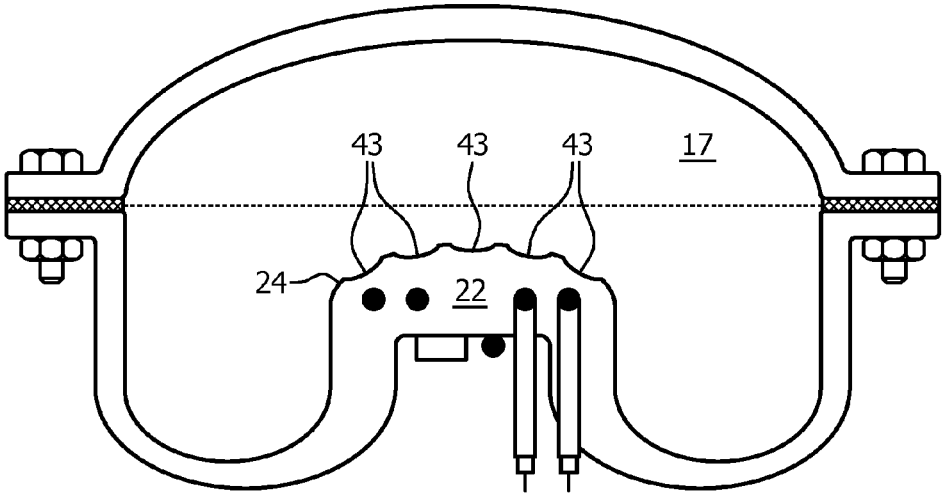
FIG. 4*b* shows a cross-section of an embodiment of apparatus for generating steam, having an evaporation surface with a plurality of recessed regions.

FIGS. 4*a* and 4*b* show alternative examples of the apparatus for generating steam described with reference to FIGS. 2 and 3. In particular, FIGS. 4*a* and 4*b* show cross-sections of embodiments of the apparatus for generating steam, wherein the evaporation surface 24 is provided one or more regions 42, 43 with recessed features.

As shown in FIG. 4*a*, one embodiment has an evaporation surface 24 with a single curved recess 42 that extends across the evaporation surface 24, into the evaporation element 22. The recess 42 is curved in a concave manner, such that water being fed onto the evaporation surface 24 flows towards the centre of the evaporation surface 24, forms a film on the evaporation surface 24 and is evaporated.

FIG. 4*b* shows an alternative example comprising a plurality of recessed regions 43 disposed around the evaporation surface 24. In this case, the recessed regions 43 prevent water being fed onto the evaporation surface 24 from having a predominant direction of flow, which may prevent the formation of an evenly spread film of water on the evaporation surface 24. The recessed regions 43 cause the water to flow in different directions and spread evenly across the evaporation surface 24, so that the film of water is substantially even and evaporation of the water occurs on all parts of the evaporation surface 24.

The recessed regions 42, 43 on the evaporation surface 24, as described with reference to FIGS. 4*a* and 4*b*, cause the water from the water inlet to be more evenly spread over the evaporation surface 24. This is particularly important if the apparatus is orientated such that the water inlet is not directly above the evaporation surface 24, or if any movement of the apparatus, for example a sideways movement, means that the water from the water inlet is not being fed straight onto the centre of the evaporation surface 24. The depth of the recessed regions 42, 43 should be such that water does not collect in the recessed regions 42, 43. On the contrary, water being fed onto the evaporation surface 24 should be quickly evaporated, in the recessed regions 42, 43 or elsewhere on the evaporation surface 24, without the water pooling in the recessed regions 42, 43. This ensures that the water is quickly evaporated and does not reach the scale collection region 23, and also ensures that thermal shock is induced in scale which has formed on the evaporation surface.

Figure 5A:
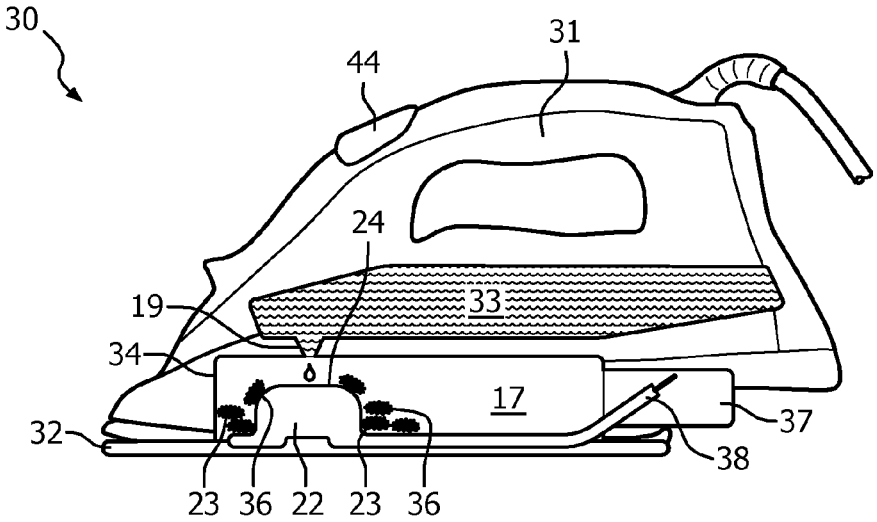
FIG. 5*a* shows a cross-section of a steam iron, having the apparatus of FIGS. 2 and 3, disposed in an operational position.
Figure 5B:
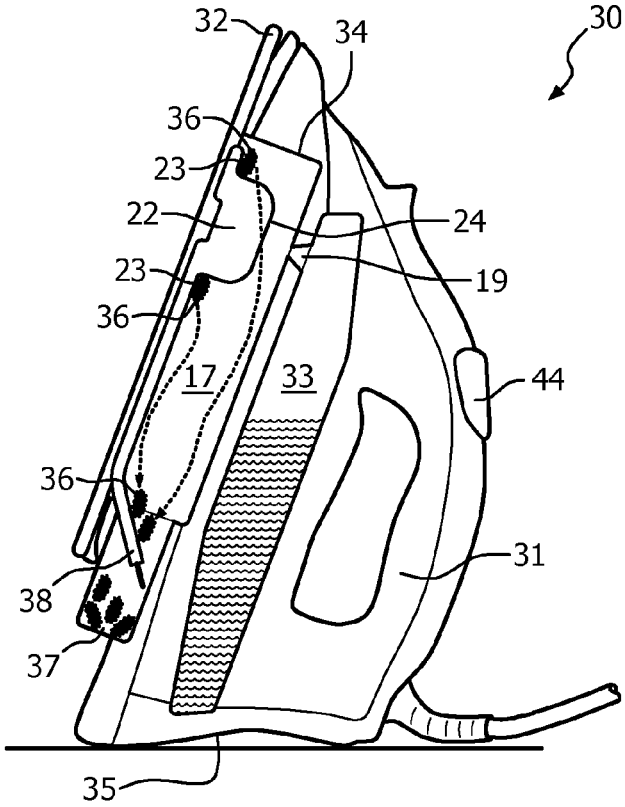
FIG. 5*b* shows the steam iron of FIG. 4 disposed in a rest position.

FIGS. 5*a* and 5*b* show a steam iron device 30 that comprises apparatus 13 for generating steam similar to that described with reference to FIGS. 2 and 3. As shown in FIG. 5*a*, the steam iron 30 has a handle 31 for a user to grip and a soleplate 32 which is pressed against garments to remove wrinkles. The soleplate 32 includes a plurality of openings (not shown) through which steam can travel to be imparted onto the garments. Also shown, the device 30 has a water storage area 33 which is connected to a water inlet 19 (see FIG. 2) similar to that described with reference to FIG. 2. The device 30 also includes a casing 34 which is shaped substantially similar to that described with reference to FIGS. 2 and 3 and may or may not be formed of two separate parts, as previously described. In particular, a sealed steam chamber 17 is defined and the water inlet 19 is formed in the top of the steam chamber 17 above an evaporation element 22 which is disposed below the water inlet 19 when the soleplate 32 is horizontally or nearly horizontally flat against a evaporation surface, which is the typical operational position of the device 30. The evaporation element 22 protrudes into the steam chamber 17 and a scale collection region 23 is formed around the evaporation element 22 in a manner similar to that described with reference to FIGS. 2 and 3.

When the device 30 is in the operational position shown in FIG. 5*a* any water in the water storage area 33 will flow to the bottom of the water storage area 33 where the water inlet 19 is located. Therefore, in the operational position, with the soleplate disposed horizontally or near horizontally, water is able to flow through the water inlet 19, into the steam chamber 17 and onto the evaporation surface 24 to produce steam.

As shown in FIG. 5*b*, the device can be placed in a rest position whereby the device is stood on an end face 35 such that the heated soleplate 32 is angled upwards. In this rest position, water in the water storage area 33 will flow downwards towards the end face 35 of the device and away from the water inlet 19 so that no water can pass through the water inlet 19 and into the steam chamber 17. Therefore, in this position, no steam is generated and the device is in a rest position.

As previously described, when the device is in use, with the soleplate 32 placed against a substantially horizontal evaporation surface, water from the water storage area 33 flows through the water inlet 19 and into the steam chamber 17. The arrangement of the water inlet 19 and evaporation element 22 means that the water entering the steam chamber 17 is fed onto the heated evaporation surface 24 within the steam chamber 17. Therefore, when the device is placed in an operational position, water is fed onto the evaporation element 22 and steam is produced in the same way as described with reference to the apparatus of FIGS. 2 and 3. In particular, the water is evaporated on the evaporation element 22 and therefore prevented from reaching the scale collection region 23. Also, scale is prevented from accumulating on the evaporation element 22 and loose scale is collected in the adjacent scale collection region 23.

The water inlet 19 may be an opening through which water can pass when the steam iron 30 is placed in an operational position, as shown in FIG. 5*a*. Alternatively, the water inlet 19 may include a button operated sealing part that is moved to allow water to flow through the water inlet 19 when a user presses a button or other user interface, such as the button 44 disposed on the handle 31. In this way, steam may only be produced when the user presses the button and water is allowed to flow into the steam chamber. Alternatively, the water inlet 19 may include an electronically controlled sealing part which is triggered to move into an open position when a sensor detects a lack of steam or pressure in the steam chamber 17.

Steam being produced in the steam chamber 17 may be able to flow directly out of openings in the soleplate 32, or it may alternatively be retained within the steam chamber 17 until the user releases the steam by pressing a button or other user interface to create an opening through which the steam can exit the steam chamber 17.

The evaporation element 22 and the scale collection region 23 are configured in the same manner as the apparatus described with reference to FIGS. 2 and 3. Therefore, any scale produced by evaporation of the water on the evaporation surface 24 will be dislodged from the evaporation surface 24 due to thermal shock, the curved shape of the evaporation surface 24 of the evaporation element 22 and any coating on the evaporation surface 24, as previously explained. The loose powder and flakes of scale then move down into the scale collection region 23 where they accumulate in a location which is separate from the evaporation surface on which water is evaporated.

As shown in FIG. 5*a*, when the device is in use, with the soleplate 32 disposed against a substantially horizontal evaporation surface, any scale being generated by the evaporation of water on the evaporation surface 24 will accumulate in the scale collection region 23 around the evaporation element 22, as previously described. As shown in FIG. 5*b*, when the device is moved into its rest position, with the soleplate 32 directed sideways or at an angle, any loose scale 36 that has collected in the scale collection region 23 may fall down to a lower end of the steam chamber 17 where a scale collection chamber 37 is disposed. The scale collection chamber 37 is configured to retain the scale that enters the scale collection chamber 37 and prevent it from re-entering the steam chamber 17. Scale is retained in the scale collection chamber 37 regardless of the position or orientation of the device. The scale collection chamber 37 may include an openable door or similar means of access that allows a user to open the scale collection chamber 37 and remove any accumulated scale. Alternatively, the scale collection chamber 37 may be removable from the device 30 for disposal of accumulated scale and any necessary cleaning. In an alternative example, the scale collection chamber 37 may not be removable or openable and may simply provide a volume in which scale is stored indefinitely. In this example, the scale collection region 23 surrounding the evaporation element 22 can be reduced in size because scale will move into the scale collection chamber 37 which is separated from the evaporation element 22 and the steam production so that the steam being produced is not exposed to the scale.

As shown in FIG. 5*b*, the rest position of the device 30 is defined by the end face 35 of the device 30 on which the device may be placed. In this example, the end face 35 is configured such that the apparatus for generating steam is disposed such that the evaporation element 22 is angled downwards. In this way, the sides of the evaporation element 22 are inclined downwards from the scale collection region 23 and loose scale 36 can move out of the scale collection region 32, along and past the evaporation element 22 and through the steam chamber 17 to the scale collection chamber 37. The scale collection chamber 37 is positioned close to the end face 35 on which the device is rested so that scale can fall into the scale collection chamber 37 under the force of gravity when the device is placed in the rest position.

As shown in FIGS. 5*a* and 5*b*, the device 30 may optionally further include an angled plate 38 disposed between the main steam chamber 17 and the scale collection chamber 37. This plate 38 is angled such that when the device 30 is in the rest position, as shown in FIG. 5*b*, scale falling towards the scale collection chamber 37 is directed into the scale collection chamber 37 along one side of the angled plate 38. On the other hand, any scale that is already in the scale collection chamber 37 will be trapped and prevented from coming out of the scale collection chamber 37 by the opposite side of the angled plate 38. In this way, loose scale is collected in the scale collection chamber 37 during normal use of the device and can be removed at any time, but cannot move back into the main part of the steam chamber 17 while water is being evaporated during use.

Any scale generated during use of the device 30 described with reference to FIGS. 5*a* and 5*b* will initially accumulate in the scale collection region which surrounds the evaporation element 22. Once the device is placed in a rest position then that accumulated scale may move through the steam chamber 17 and into a scale collection chamber 37. Therefore, scale is prevented from accumulating within the steam chamber 17 and is kept separate from the evaporation surface 24 where steam is generated.

The apparatus for generating steam in the device described with reference to FIGS. 5*a* and 5*b* requires little if any cleaning to remove scale and little if any maintenance to avoid scale accumulation. Therefore, performance and longevity of the device are improved as the reduced scale accumulation will avoid insulation of the evaporation element and any blockages that the scale may cause. By preventing scale from accumulating on the evaporation surface and configuring the apparatus to collect loose scale in a position separate to the evaporation surface, the problems associated with scale accumulation are overcome.

It will be appreciated that the apparatus for generating steam described with reference to FIGS. 2 and 3 may be used in any kind of device or apparatus that requires steam and not only in the steam iron device described with reference to FIGS. 5*a* and 5*b*. Moreover, it will be appreciated that the components and arrangements of the apparatus for generating steam may be altered for different applications without deviating from the invention defined in claim 1. For example, a garment steamer may require that the casing comprises an outlet which can be attached to a hose for conveying steam to an applicator head. Alternatively, another kind of steam generator may require apparatus for generating steam that has a differently shaped casing.

It should be noted that the above-mentioned embodiments illustrate rather than limit the invention, and that those skilled in the art will be able to design many alternative embodiments without departing from the scope of the appended claims. It will be appreciated that the term "comprising" does not exclude other elements or steps and that the indefinite article "a" or "an" does not exclude a plurality. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. An apparatus for generating steam, the apparatus comprising an evaporation element having an evaporation surface, a scale collection region, a heater disposed adjacent to the evaporation surface to heat the evaporation surface, wherein the heater is more proximate to the evaporation surface than to the scale collection region, a water inlet positioned relative to the evaporation surface so that water is fed onto the evaporation surface from the water inlet and forms a film on the evaporation surface such that said film is evaporated from said evaporation surface, and wherein the scale collection region positioned such that, during use of the apparatus, scale dislodged from the evaporation surface falls away from said evaporation surface into said scale collection region, wherein the apparatus is configured so that a flow of the water through the water inlet and onto the evaporation surface is controlled in dependence on a temperature of the evaporation surface so that substantially all the water fed onto the evaporation surface is evaporated from said evaporation surface without flowing from the evaporation surface into the scale collection region;

further comprising a scale collection chamber and a channel disposed such that when the apparatus is rotated from an operational position, in which said water is provided to the evaporation surface, into a rest position, in which said water is not provided to the evaporation surface, scale dislodged from the evaporation surface will pass along said channel from said scale collection region and into said scale collection chamber which is configured to retain said scale.

2. The apparatus of claim 1, wherein the evaporation element and the scale collection region are arranged such that the evaporation element includes an incline between the evaporation surface and the scale collection region.

3. The apparatus of claim 1, further comprising a casing which defines a steam chamber, the evaporation element extending into the steam chamber from one side of the casing and the scale collection region being formed within the steam chamber, adjacent to the evaporation element.

4. The apparatus of claim 1, wherein the water inlet is configured to feed water onto two or more regions of the evaporation surface.

5. The apparatus of claim 1, wherein the water inlet is configured to alternately feed the water onto at least two or more regions of the evaporation surface.

6. The apparatus of claim 1, wherein the evaporation surface has a shaped profile to generate a predetermined steam rate.

7. The apparatus of claim 6, wherein the evaporation surface includes a curved or dome shaped profile.

8. The apparatus of claim 1, wherein the evaporation surface includes one or more regions with recessed features.

9. The apparatus of claim 1, wherein the evaporation element includes a wall having varying thickness such that, when the evaporation surface is heated or cooled during use, thermal expansion will cause a size and/or a shape of the evaporation surface to change in an irregular manner to dislodge scale from the evaporation surface.

10. The apparatus of claim 1, wherein the scale collection chamber is openable to allow a user to remove scale from the scale collection chamber.

11. The apparatus of claim 1, wherein the heater is embedded within the evaporation element.

12. The apparatus of claim 1, wherein the heater includes a spiral heating element.

13. The apparatus of claim 1, wherein the scale collection region is at least partially isolated from the heater or remotely located from the heater so that the scale collection region is indirectly heated by the heater via the evaporation of water from the evaporation surface.

14. A device for applying steam to an article, comprising the apparatus for generating steam according to claim 1.

15. An apparatus for generating steam, the apparatus comprising an evaporation element having an evaporation surface, a scale collection region, a heater disposed adjacent to the evaporation surface to heat the evaporation surface, wherein the heater is more proximate to the evaporation surface than to the scale collection region, a water inlet positioned relative to the evaporation surface so that water is fed onto the evaporation surface from the water inlet and forms a film on the evaporation surface such that said film is evaporated from said evaporation surface, and wherein the scale collection region positioned such that, during use of the apparatus, scale dislodged from the evaporation surface falls away from said evaporation surface into said scale collection region, wherein the apparatus is configured so that a flow of the water through the water inlet and onto the evaporation surface is controlled in dependence on a temperature of the evaporation surface so that substantially all the water fed onto the evaporation surface is evaporated from said evaporation surface without flowing from the evaporation surface into the scale collection region; and wherein the scale collection region is at least partially isolated from the heater or remotely located from the heater so that the scale collection region is indirectly heated by the heater via the evaporation element to a lower temperature than said evaporation surface.

16. The apparatus of claim 15, wherein the evaporation element and the scale collection region are arranged such that the evaporation element includes an incline between the evaporation surface and the scale collection region.

17. The apparatus of claim 15, wherein the evaporation surface has a shaped profile to generate a predetermined steam rate.

18. The apparatus of claim 15, wherein the heater is embedded within the evaporation element.

* * * * *